United States Patent [19]

Snyder et al.

[11] Patent Number: 4,792,385

[45] Date of Patent: Dec. 20, 1988

[54] ELECTROLYTIC DECONTAMINATION APPARATUS AND ENCAPSULATION PROCESS

[75] Inventors: Thomas S. Snyder, Oakmont; Alexander P. Murray, Murrysville, both of Pa.

[73] Assignee: Westinghouse Electric Corp., Pittsburgh, Pa.

[21] Appl. No.: 116,088

[22] Filed: Nov. 3, 1987

[51] Int. Cl.[4] ..... C25F 1/00; C25F 7/00

[52] U.S. Cl. ..... 204/140; 204/237

[58] Field of Search ..... 204/140, 237

[56] References Cited

U.S. PATENT DOCUMENTS

| | | | |
|---|---|---|---|
| 2,854,315 | 9/1958 | Alter et al. | 23/159 |
| 3,890,244 | 7/1975 | Carlin | 252/301.1 R |
| 3,891,741 | 6/1975 | Carlin et al. | 423/2 |
| 4,508,641 | 4/1985 | Hanulik | 252/626 |
| 4,537,666 | 8/1985 | Murray et al. | 204/129.95 |

*Primary Examiner*—T. M. Tufariello

[57] ABSTRACT

Both a method and apparatus for electrolytically removing radioactive metal ions from a decontamination solution to regenerate the solution and prepare the ions for disposal as disclosed herein. At least the cathodic portion of the electrode used in the electrolysis is formed from a combustible material, such as a semi-fluidized bed of graphite particles. In the method of the invention, the decontamination solution is passed in intimate contact with the graphite particles forming the cathodic portion of the electrode as an electric potential is applied to the electrode. As a result of the electric potential, the metal ions are detached from the chelate in the decontamination solution and deposited onto the graphite particles of the cathodic portion of the electrode. After the electrode becomes spent, it is incinerated in order to reduce the volume of the resulting radioactive ash. The gases produced from the incineration are scrubbed with a scrubbing liquid to remove radioactive particles therefrom. The contaminated scrubbing liquid is in turn used to form a cementitious substance or grout which encapsulates the radioactive ash. The invention provides a more effective method of removing radioactive ions from decontamination solutions, and does not create any radioactive eluants. The resulting solid waste is of small volume.

30 Claims, 2 Drawing Sheets

ELECTROLYTIC DECONTAMINATION APPARATUS AND ENCAPSULATION PROCESS

BACKGROUND OF THE INVENTION

This invention generally relates to an apparatus and process for electrolytically removing radioactive ions from a decontamination solution in order to regenerate the same. The invention also reduces the ions to small volume of metals and ash which are easily encapsulated in a cementitious matrix without the formation of liquid radioactive wastes.

Various methods for removing the radioactive ions from chemical decontamination solutions are known in the prior art. However, before these removal methods are discussed, a brief description of the purpose and composition of the decontamination solutions themselves will be given so that the significance of the invention may be more easily appreciated.

Generally, the decontamination solutions that the invention pertains to are used to remove magnetite deposits that gradually build up in the water conduits which form the cooling system of nuclear reactors. The magnetite deposits contain radioactive metals, and the removal of these deposits is necessary to safely maintain and repair such cooling systems. These deposits are typically removed by first treating them with an oxidizing solution, such as one containing an alkaline permanganate, to remove the chromium therefrom. This step renders the magnetite much more dissolvable in an acidic solution. The chromium-depleted magnetite deposits are then treated with a decontamination solution, which is an aqueous solution of a chelate, such as ethylenediaminetetraacetic acid (EDTA), and a solubilizing agent, such as a mixture of oxalic acid and citric acid. Other chelates which may be used include oxybis (ethylenedraminetetracetic acid) (EEDTA), and nitrilotriacetic acid (NTA). The chelate forms a complex with the radioactive metal ions from the magnetite deposits and solubilizes them, thus preventing them from precipitating out of the solution at another location in the cooling system.

Ultimately, the radioactive metal ions captured by the chelate must be removed from the decontamination solution in order to regenerate the solution. Moreover, the removed radioactive ions must then be put into a form which is easily and inexpensively disposable. One prior art method for removing the ions from the decontamination solution involved circulating the solution between the cooling system of the nuclear reactor and a cation exchange resin. The chelated metal ions were deposited on the cation exchange resin, freeing the chelates to solubilize additional metal ions in the deposit. However, since both the chelates and the cation exchange resin compete for the metal ions, the ions do not readily leave the chelate and attach themselves to the ion exchange column. As a result, long resin contact times are required, and the resulting column effluent may include relatively large amounts of liquid wastes containing high concentrations of radioactive ions. Hence, in addition to taking a lengthy amount of time to effect decontamination, this ion exchange process creates a radioactive liquid effluent that is relatively difficult and expensive to dispose of.

To solve these problems, the inventors developed an electrolytic method for removing these metal ions from the chelates in the decontamination solutions. This new method is described in and claimed U.S. Pat. No. 4,537,666 issued Aug. 27, 1985, and assigned to the Westinghouse Electric Corporation. Generally speaking, this process passes the decontamination solution through an electrode formed by a stainless steel or copper mesh in order to plate the ions out. When the electrode becomes completely plated out and hence spent, it is replaced with a fresh electrode.

However, while the process described and claimed in this patent represents a substantial advance in the art, the applicants have observed that there is room for improvement on several of the aspects of this invention. For example, of the volume of solid waste produced by this process (i.e., the spent and plated electrode) more than 99% is non-radioactive metal. Since the cost of disposal is directly proportional to the volume of the radioactive waste, the fact that only a very tiny volume of the metal of on the spent electrodes is radioactive is an unfortunate inefficiency. A second undesirable characteristic of the prior art electrolytic process is the fact that of the metallic electrodes actually used, some were prone to corrosion (such as copper) while others (such as stainless steel) were found to have short lifespans due to passivation. Still another undesirable characteristic of the prior art electrolytic process was the fact that the electrodes used therein had no ability to filter or adsorb impurities (such as lubricating oils and other hydrophobic compounds) which are often present in at least trace amounts in the decontamination solutions. The ion exchange column used before in the prior art did offer some filtration and adsorption capability in this regard, and while the more recently developed electrolytic process is, on the balance, far superior to the ion exchange method, the loss of this filtration and adsorption capability represents the loss of a significant advantage.

Clearly, there is a need for an improved process and apparatus for removing the metal ions from decontamination solutions which retains all of the advantages of both the prior art electrolytic and ion exchange processes, but which produces no liquid radioactive wastes. Ideally, such a process should utilize components having a long lifespan, and produce solid wastes of greatly reduced volume. Moreover, such a process should retain the filtration and adsorption advantages associated with the prior art ion exchange columns.

SUMMARY OF THE INVENTION

Generally, the invention is an improved electrolytic method and apparatus for removing radioactive ions from a solution that overcomes the aforementioned deficiencies of the prior art. The apparatus of the invention includes a cathodic electrode that is substantially made from a material that forms a gas when incinerated. In the method of the invention, the decontamination solution is circulated through the permeable electrode in order to plate the ions thereon, and then incinerated after the electrode becomes spent in order to reduce the volume of the resulting radioactive waste.

The method of the invention may include the further step of drying the spent electrode before incineration in order to expedite the incineration step of the method. The gases produced by the incineration of the electrode may be scrubbed in order to remove particles of radioactive material entrained therein. Any radioactively contaminated scrubbing liquid that results from the scrubbing step may be used to form a cementitious material that ultimately encapsulates the radioactive ash produced by the incineration step.

Basically, the apparatus of the invention includes means for carrying out the method of the invention, including permeable electrode having both an anode and a cathode that is separated by an insulator. The electrode is formed from a bed of particulate carbon for four reasons. First, carbon is easily combustible to a very small volume of ash. Secondly, carbon such as graphite is readily and cheaply available in very fine mesh sizes, thereby insuring a maximum amount of intimate contact between the decontamination solution and the cathodic portion of the electrode, as well as a long service life.. Thirdly, carbon is an excellent filtration and adsorbent material that is capable of removing trace amounts of lubricating oils and other impurities which may be present in the decontamination solution. Finally, carbon is noncorrodible.

In the preferred embodiment, the anode as well as the cathode is formed from a bed of particulate carbon in order to fully exploit the filtration and adsorption properties of the carbon as the decontamination solution is passed therethrough. While both the anode and the cathode may be formed from a packed bed of fine mesh graphite, a fluidized bed is preferred. Such a fluidized bed has superior anti-clogging properties as more and more metal is plated onto the graphite particles, and incinerates more evenly with a minimum amount of clinker formation.

In order to determine when the electrode becomes spent, the apparatus of the invention may include a differential pressure sensor for measuring the pressure drop in the solution across the electrode. The presence of a significant pressure drop indicates that a substantial portion of the surface area of the cathodic portion of the electrode has been metal plated and hence spent. To implement the incineration step of the method, the apparatus includes a fluidized bed incinerator for applying a uniform heat to the graphite electrode particles which both expedites incineration, and avoids the formation of clinkers. This is significant, since clinker formation can significantly increase the volume of the resulting radioactive ash. To implement the drying step of the method, a microwave unit is also included in the apparatus.

Finally, to implement the scrubbing and encapsulation step of the method, the apparatus includes both a scrubbing station and an encapsulation station. These two stations are placed into fluid communication so that radioactively contaminated scrubbing liquid from the scrubbing station may be used to mix the cementitious material or grout used to encapsulate the radioactive ash.

BRIEF DESCRIPTION OF THE SEVERAL FIGURES

FIG. 1 is a schematic diagram of the apparatus of the invention, and

FIGS. 2A, 2B, and 2C are a perspective, cross sectional side view and enlarged view of the electrode used to implement the method of the invention, respectively.

DETAILED DESCRIPTION OF THE PREFERRED EMBODIMENT

Figure 1:
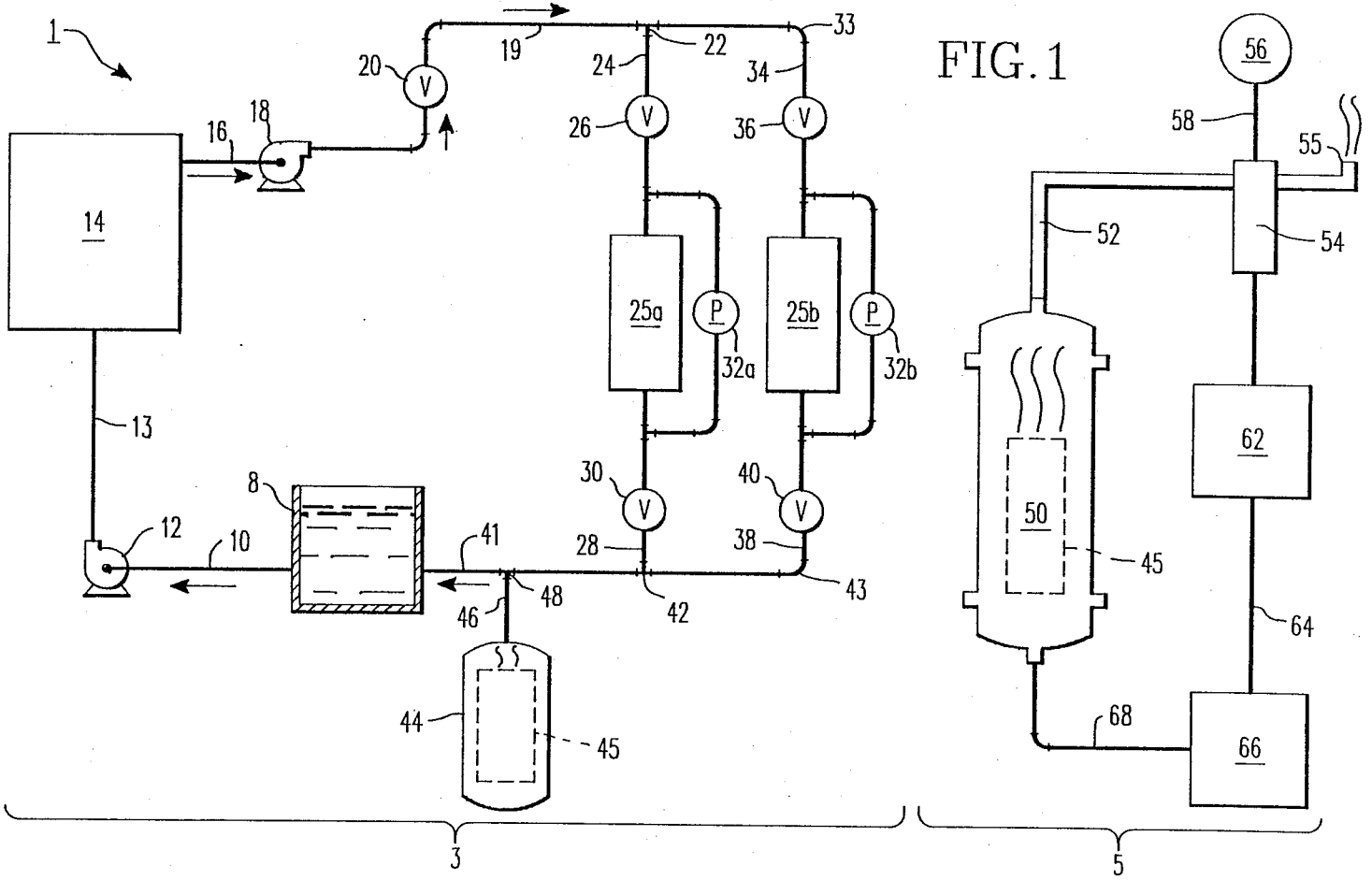

With reference now to FIG. 1, wherein like numbers designate like components throughout all the several figures, the decontamination apparatus 1 of the invention is formed from both a solution regeneration system 3 that regenerates a decontamination solution circulating through a steam generator, and an incineration and encapsulation system 5 that incinerates the completely plated and spent electrodes produced by the solution regeneration system 3.

The solution regeneration system 3 includes a feed tank 8 which serves as a reservoir for the decontamination solution used in the system 3. The tank 8 may hold any decontamination solution which contains a chelate for metal ions. Chelates are complexing agents generally having an equilibrium constant from metal ions of greater than about $10^{15}$. Examples of such chelates include EDTA, trans, 1,2-diminocyclohexanetetraacetic acid (DCTA), oxybis (ethylenediaminetetraacetic acid) (EEDTA), and nitrilotriacetic acid (NTA). Such decontamination solutions will also generally contain one or more solubilizing agents, such as citric acid or oxalic acid.

An outlet conduit 10 fluidly connects the feed tank 8 to an inlet pump 12. The outlet of the pump 12 is connected to the inlet conduit 13 of the steam generator 14 or other device having radioactive deposits to be removed. An outlet conduit 16 directs the decontamination solution that has been circulated within the steam generator 14 into an outlet pump 18. The outlet of the pump 18 is in turn fluidly connected to a main electrode inlet conduit 19. A valve 20 is included in the main electrode inlet conduit 19 for controlling the flow of used decontamination solution into the electrode cells **25*a*, 25*b***.

Electrode inlet conduit 19 includes a t-joint 22 for connecting this conduit to the inlet conduit 24 of electrode cell **25*a*. An upstream isolation valve 26 is included in the inlet conduit 24 for isolating the electrode cell 25*a* from the flow of used decontamination solution from the conduit 19. Connected to the outlet end of the electrode cell 25*a* is an outlet conduit 28 which is in turn connected to a conduit 41 leading into the inlet of the feed tank 8. Outlet conduit 28 includes a downsteam isolation valve 30. When isolation valves 26 and 30 are both closed, the electrode cell 25*a* is completely brought off-line of the system 3. A differential pressure sensor 32*a* is connected across the inlet and outlet conduits 24 and 28 to monitor the pressure drop associated with the electrode 45** disposed therein.

A second electrode cell **25*b* is connected in parallel to the electrode inlet conduit 19 via L-joint 33. The L-joint 33 is fluidly coupled to an inlet conduit 34 which, like inlet conduit 24, also includes an upstream isolation valve 36. The outlet of the cell 25*b* further includes an outlet conduit 38 which, like the previously discussed outlet conduit 28, includes a downsteam isolation valve 40. An inlet conduit 41 leading to the feed tank 8 is connected to the outlet conduits of the electrode cells 25*a* and 25*b* by way of t-joint 42 and L-joint 43, respectively. Also connected to the feed tank inlet conduit 41 is a microwave drying unit 44. Unit 44 is used to dry the electrodes 45 (indicated in phantom) that are encased within electrode cells 25*a* and 25*b* after these electrodes 45 become spent. The microwave drying unit 44 includes an outlet conduit 46 for leading evaporated, radioactive eluants back into the inlet conduit 41 via t-joint 48**.

In operation, both of the electrode cells **25*a* and 25*b* are normally operated on-line. However, each of the cells, 25*a*, 25*b*, is capable of at least temporarily handling the load on the system 3. Normally, a direct current voltage of between about 1 to 10 volts is applied across the electrodes 45 disposed in each of the cells 25*a* and 25*b*, the exact voltage depending upon the ion affinity of the particular chelate used. However, as the pressure differential (as indicated by differential pressure sensors 32***a* and 32*b*) becomes larger as a result of radioactive metallic ions plating out on the particles of graphite that form the cathodes of the electrodes 45, this voltage may be raised slightly in order to compensate for the diminishing amount of surface contact between the decontamination liquid and the particles of graphite. When either of the pressure sensors 32*a* or 32*b* displays a pressure drop that indicates that the electrodes 45 within either of the cells 25*a* or 25*b* is spent, the cell is isolated by closing off the isolation valves 26, 30, or 36, 40 disposed in its inlet and outlet conduits. As the electrode 45 within one cell is replaced, the other cell temporarily assumes the load of the system. It should be noted that just before the electrode 45 within either of the cells 25*a*, 25*b* is replaced, the pump 18 should be pulsed one last time to break up any clumps of congealed graphite particles in the electrode, thereby facilitating both the drying and the burning of the electrode 45.

The spent electrode 45 is then disposed in the microwave drying unit 44 to rid it of all water and radioactive eluants. Such drying also facilitates the uniform incineration of the electrode 45, as will be appreciated shortly.

The incineration and encapsulation system 5 of the invention 1 includes an incinerator 50 for combusting the spent graphite electrodes 45 produced by the solution regeneration system 3. In the preferred embodiment, the incinerator 50 is a fluidized bed type incinerator of a type known in the prior art. Alternatively, the incinerator 50 may be a rotary-kiln type incinerator, such as a model RC60 or RC120 coldwalled rotating combuster manufactured by the O'Conner Combuster Works located in Pittsburgh, Pa. The use of either type of incinerator insures a uniform burning of the graphite electrode 45 which minimizes the formation of clinkers which could unduly increase the volume of the resulting radioactive ash. However, of the two types, the use of a fluidized bed incinerator is slightly preferred since the possibility of clinker formation is the smallest with this particular type of incinerator. At its top, the incinerator 50 includes an an outlet flue which is connected to a venturi-type scrubber 54.

The scrubber 54 removes radioactive particles entrained in the carbon dioxide and other gases which are produced by the combustion of the carbon electrode 45 so that the gases leaving the flue outlet 55 are free of such radioactive particles. The scrubber 54 operates by spraying a mist of water through the flue gases flowing therethrough. This water comes from a water reservoir 56 connected to a water inlet conduit 58. After the water droplets have been sprayed through the flue gases, these droplets (and the radioactive particles which they have removed from the flue gases) are collected in a drain which flows via a drain conduit 60 into a cement mixing station 62. This water (which is mildly radioactively contaminated) is mixed with a grouting compound to form a cementitious matrix for encapsulating the radioactive ash produced by the incinerator 50. The unhardened grout produced by the cement mixing station 62 is conducted via a conduit 64 into an encapsulation station 66. Encapsulation station 66 also receives all of the radioactive ash produced by the incinerator 50 via incinerator outlet conduit 68. The ash may be encapsulated, for example, by collecting it in 55 gallon drums which are then compressed and embedded in a cementitious matrix from the grout produced by the cement mixing station 62.

Figure 2A:
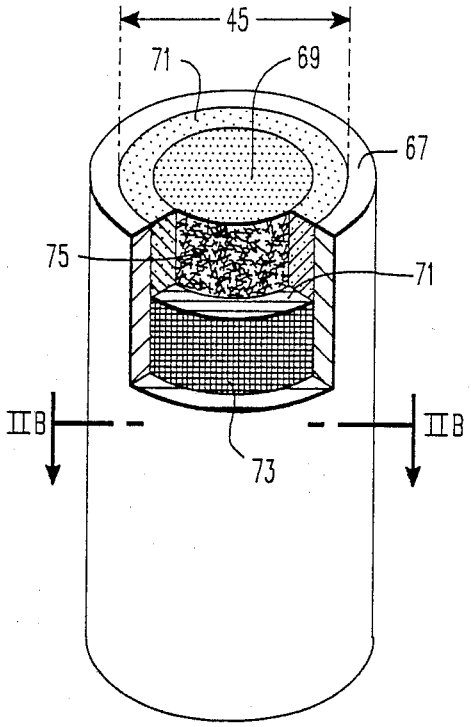
Figure 2B:
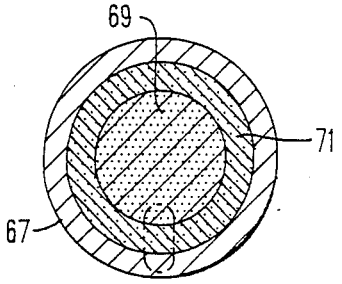
Figure 2C:
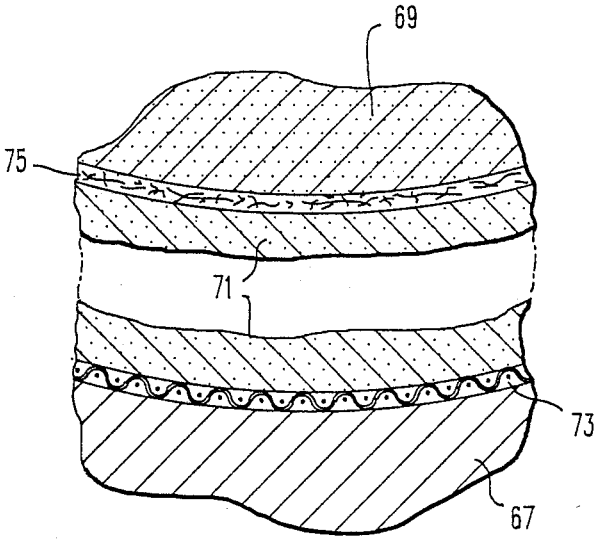

With reference now to FIGS. 2A, 2B, and 2C, the electrode 45 contained within each electrode cell 25*a*, 25*b* is cylindrical in shape, and concentrically disposed within the casing wall 67 of each of the cells 25*a* and 25*b*. The balance of the casing (not shown) may assume any one of the number of mechanical configurations, the only limitation being that the electrode 45 be relatively easily removable from and insertable into the casing wall 67. The electrode 45 is generally comprised of a cathode 69 formed from a bed of graphite particles having a size of approximately 0.1 to 5 mm. While a packed bed of such particles may be used, the bed of the preferred embodiment is preferably semi-fluidized. In such a semi-fluidized bed, the graphite particles may be agitated by pulsating the inlet pump 18. Such particle agitation advantageously counteracts the tendencies that such particles may have to congeal together as they are being plated with radioactive ions, thereby maintaining a large surface area between the decontamination fluid and the outer surface of these particles. The effective utilization of this large surface area interface not only renders the electrode 45 more effective, but further lengthens its life. Circumscribing the cathode 69 is an annular anode 71 which is also preferably formed from a semi-fluidized bed of graphite having a size of approximately 0.1 to 5 mm. To contain the fluidized bed that forms the anode 71, and to further render integrality to the structure of the electrode 45, the anode 71 is circumscribed by a water permeable nylon mesh 73. To prevent short circuiting from occurring between the cathode and the anode, and to further contain the fluidized bed of graphite particles that forms cathode 69, the cathode 69 is wrapped in a polypropylene felt 75. While other materials may be used to form the mesh 73 and felt 75, nylon and polypropylene are preferred since they are easily combustible. While powdered graphite is used in the preferred embodiment, particles of an electrically conductive plastic, such as polyacetylene may also be used.

In the preferred embodiment, the cylindrical electrode preferably has a height-to-diameter aspect ratio of one or greater. A smaller aspect ratio may not result in a long enough travel time of the spent decontamination fluid through the electrode 45, and might be prone to a disadvantageous "channelling" of a large stream of the fluid through a relatively small portion of the cross-section of the electrode.

We claim:

1. A method for removing radioactive ions from a solution in order to regenerate the solution and to prepare the ions for disposal, comprising the steps of circulating the solution through a permeable electrode to plate the ions thereon, wherein said electrode is made from a material that forms a gas when incinerated and then incinerating the plated electrode to reduce the volume thereof.

2. A method for removing and preparing for disposal radioactive metal ions that are solubilized in a decontamination solution, comprising the steps of circulating the solution through a permeable cathodic electrode that is substantially formed from a combustible material to plate the ions onto the electrode, and then combusting the plated electrode to reduce the volume thereof.

3. The method of claim 2, further including the step of drying the plated electrode before combusting it.

4. The method of claim 2, wherein the electrode is formed from a material that forms a gaseous component when combusted which results in a reduction of the solid volume of the electrode after combustion is completed.

5. The method of claim 4, wherein said electrode is substantially formed from carbon.

6. The method of claim 4, wherein said electrode is a bed of particulate graphite.

7. The method of claim 6, wherein said bed of particulate graphite is fluidized.

8. The method of claim 6, wherein said bed of particulate graphite is packed.

9. The method of claim 4, wherein the gases formed by the combustion of the electrode are scrubbed with a liquid to remove radioactive particles entrained in the gases.

10. The method of claim 9, further including the steps of mixing scrubbing liquid that has been contaminated with radioactive particles with a cementforming compound to form a cementitious substance, and encapsulating the solid mass which remains after the electrode has been combusted.

11. A method for removing radioactive metal ions from a solution and preparing them for disposal, comprising the steps of circulating the solution through a permeable electrode to remove the ions from solution by plating them onto the electrode, wherein said electrode is substantially formed from a solid material that is combustible into a gas, and combusting the plated electrode to reduce the volume of the solid material to an ash that includes said plated ions.

12. The method of claim 11, wherein said electrode is formed substantially of carbon, and further functions to filter out impurities from said solution as said solution is circulated therethrough.

13. The method of claim 11, wherein said electrode is formed from an electrically conductive plastic material.

14. The method of claim 13, wherein said electrode is formed from polyacetylene.

15. The method of claim 12, wherein said solution is circulated by a pump means that utilizes lubricants that contaminate said solution, and wherein said carbon electrode filters out said contaminating lubricants.

16. The method of claim 11, wherein said plated electrode is combusted in a fluidized bed incinerator to minimize clinker formation.

17. The method of claim 11, wherein the gases formed by the combustion of the electrode are scrubbed with a liquid to remove radioactive particles entrained in the gases.

18. The method of claim 17, further including the steps of mixing scrubbing liquid that has been contaminated with radioactive particles with a cementforming compound to form a cementitious substance, and encapsulating the solid mass which remains after the electrode has been combusted.

19. The method of claim 11, further including the step of drying the electrode prior to combusting it by means of microwave source.

20. The method of claim 11, wherein said ions are solubilized in a decontamination solution that includes a chelate selected from the group consisting of ethylenediaminetetracetic acid, nitrilotriacetic acid, trans, 1, 2-diaminocyclohexanetetraacetic acid, oxybis (ethylenediaminetetraacetic acid) and mixtures thereof.

21. A method for removing radioactive metal ions from a decontamination solution wherein said ions are solubilized by a chelate selected from the group consisting of oxybis (ethylenediaminetetraacetic acid), nitrilotriacetic acid, ethylenediaminetetraacetic acid, trans, 1, 2-diaminocyclohexanetetraacetic acid and mixtures thereof, comprising the steps of:

a. circulating the solution through a permeable cathodic electrode formed from a bed of particulate carbon by means of a pump in order to plate said ions onto the electrode;
b. monitoring the pressure differential in the solution across the electrode to determine when said electrode is spent;
c. removing the electrode when a pressure differential of a preselected amount is detected in the solution across said electrode;
d. drying the electrode by exposing the same to a source of microwave;
e. incinerating the carbon electrode in a fluidized bed incinerator to reduce it to ash that contains the plated metal ions;
f. scrubbing the gases generated by the carbon electrode to remove radioactive particles therefrom by means of a scrubbing liquid;
g. making a cementitious substance by mixing scrubbing liquid that has been used to scrub said gases and that is contaminated with radioactive particles with a cementitious mix, and
h. encapsulating said ash containing said plated metal ions in said cementitious substance.

22. An apparatus for removing radioactive metal ions from a decontamination solution and preparing them for encapsulation, comprising a. an electrode having a removable, permeable cathode for plating out said metal ions from said solution, wherein said cathode is substantially formed from a material that forms a gaseous compound when incinerated, and
b. incinerator means for heating said permeable cathode after said cathode becomes substantially plated with said ions in order to reduce the solid mass of the ion-containing cathode to an ash.

23. The apparatus defined in claim 22, further including means for drying said cathode after said cathode is removed and before said cathode is heated.

24. The apparatus defined in claim 22, wherein said cathode is formed from a bed of carbon particles.

25. The apparatus defined in claim 22, wherein said incinerator means is a rotary kiln that combusts said cathode.

26. The apparatus defined in claim 22, further including means for scrubbing the gaseous compound created by the heating of the cathode with a liquid in order to remove any radioactive particles entrained in said gaseous compound.

27. The apparatus defined in claim 26, further including means for mixing a cementitious substance for encapsulating said ash.

28. The apparatus defined in claim 27, wherein scrubbing liquid that has been used to scrub said gaseous compound in said scrubbing means is conducted to the mixing means and used to form said cementitious substance.

29. The apparatus defined in claim 22, wherein said permeable cathode of said electrode is substantially cylindrical, and surrounded by an anode, and wherein said anode and cathode are separated by a semi-permeable membrane.

30. The apparatus defined in claim 27, further including means for measuring the pressure differential in the solution across the permeable cathode in order to determine when said cathode is substantially spent.

* * * * *